US007637738B2

(12) United States Patent
Conover

(10) Patent No.: US 7,637,738 B2
(45) Date of Patent: Dec. 29, 2009

(54) SCENTED CANDLE WITH MULTIPLE SCENT COMPONENTS

(75) Inventor: Donald Conover, Buffalo Grove, IL (US)

(73) Assignee: Belle-Aire Fragrances, Inc., Mundelein, IL (US)

( * ) Notice: Subject to any disclaimer, the term of this patent is extended or adjusted under 35 U.S.C. 154(b) by 518 days.

(21) Appl. No.: 11/170,223

(22) Filed: Jun. 29, 2005

(65) Prior Publication Data

US 2007/0003895 A1 Jan. 4, 2007

(51) Int. Cl.
*F23D 3/16* (2006.01)
*A01N 25/20* (2006.01)

(52) U.S. Cl. ..... 431/289; 431/288; 431/291; 422/122; 422/125; 422/126

(58) Field of Classification Search ..... 431/288, 431/289, 291; 422/125, 126, 305, 5
See application file for complete search history.

(56) References Cited

U.S. PATENT DOCUMENTS 4,427,366 A * 1/1984 Moore ..... 431/291
4,566,270 A * 1/1986 Ballard et al. ..... 60/264
4,855,098 A * 8/1989 Taylor ..... 264/103
6,079,975 A 6/2000 Conover
6,203,313 B1 * 3/2001 Holmes et al. ..... 431/288
6,551,099 B1 * 4/2003 Kapinski ..... 431/288
2001/0001706 A1 * 5/2001 Orlandi ..... 431/289
2002/0102187 A1 * 8/2002 Bellenger et al. ..... 422/126
2005/0276040 A1 * 12/2005 Dennis et al. ..... 362/161

FOREIGN PATENT DOCUMENTS

EP 994177 A2 * 4/2000

* cited by examiner

*Primary Examiner*—Steven B McAllister
*Assistant Examiner*—Nikhil Mashruwala
(74) *Attorney, Agent, or Firm*—Schiff Hardin LLP

(57) ABSTRACT

A candle and appertaining methods of manufacturing and using the candle involve a candle having a first section with a first wax that melts at a first temperature, and a second section with a second wax with a fragrance that melts at a second temperature so that the candle can be manufactured to keep the first wax and the second wax separate during manufacture and storage, but so that the first wax and the second wax combine when burning. The second section can comprise multiple inner portions, each having their own unique fragrance, the candle being constructed so that the fragrances combine when the candle is burned.

11 Claims, 1 Drawing Sheet

SCENTED CANDLE WITH MULTIPLE SCENT COMPONENTS

BACKGROUND OF THE INVENTION

1. Field of the Invention

The present invention relates generally to a scented candle having multiple parts and in particular to a scented candle in which the multiple parts have different scents.

2. Description of the Related Art

Candles are frequently used as decorating items and to set a particular mood while the candle is burning. Scented candles utilize a scent agent, typically an a scented oil, that is added to the wax of the candle during manufacture and that releases a scent during burning of the candle. The scent may be provided in different concentrations for different candles and a growing trend is to provide highly scented candles having a strong concentration of the scent agent. One disadvantage of scented candles is that the scent agent dissipates from the candle wax when the candle is sitting unburned for a period of time, such as during storage or display. Little of the scent remains in the candle to be released during burning of the candle. Another disadvantage is that the scent agents may chemically change do to aging effects during extended storage so as to loose effectiveness of the scent.

SUMMARY OF THE INVENTION

The present invention relates generally to a candle having multiple scents in a single candle. In particular, the candle includes multiple regions or portions, which are positioned to melt simultaneously during burning of the candle. Each of the regions include a different scent or scent agent so that burning of the candle blends the scent agents together to provide a new combined scent. This configuration provides better stability and better blooming and increases the fragrance life of the candle. This configuration also reduces reactivity, which prevents dissipation of the fragrance in the candle.

BRIEF DESCRIPTION OF THE DRAWINGS

The drawings below illustrate various embodiments of the invention.

DETAILED DESCRIPTION OF THE PREFERRED EMBODIMENTS

Figure 1:
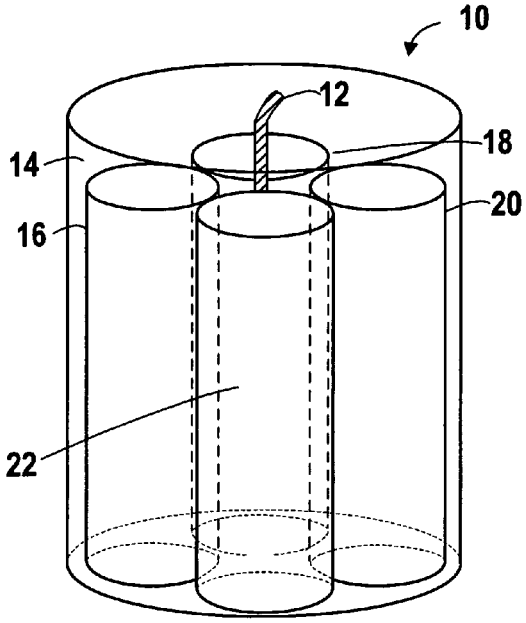
FIG. 1 is a perspective view of a first embodiment of a candle having multiple scented regions therein according to the principles of the present invention.

With reference first to FIG. 1, a scented candle 10 is provided having a wick 12, which is lit to cause the candle wax of the candle to melt and burn. The candle 10 has an outer coating 14 of a first wax and inner portions 16, 18, 20 and 22 disposed within the candle 10. Each of the portions 16, 18, 20 and 22 are of a different material than the outer portion 14.

In a preferred embodiment, the outer portion 14 is a wax having a first scent component, the inner portion 16 is a wax containing a second scent component, the inner portion 18 is a wax containing a third scent component, the inner portion 20 is a wax containing a fourth scent component, and the inner portion 22 is a wax containing a fifth scent component. The inner portions 16 through 22 are disposed so as to melt simultaneously or substantially simultaneously with one another and with the outer shell portion 14 so that the scent components have the portions 14 through 22 mixed together in the melted wax as the candle burns. As is apparent from FIG. 1. the inner portions 16 through 22 have the same length and extend between the same two horizontal planes.

In one embodiment, the four different inner candle components have four different components of the desired scent to be produced by the candle. The scent components or accords may be provided in different percentages of the scent agents or fragrance additives in each of the inner portions 16 through 22 to achieve the desired result.

Figure 2:
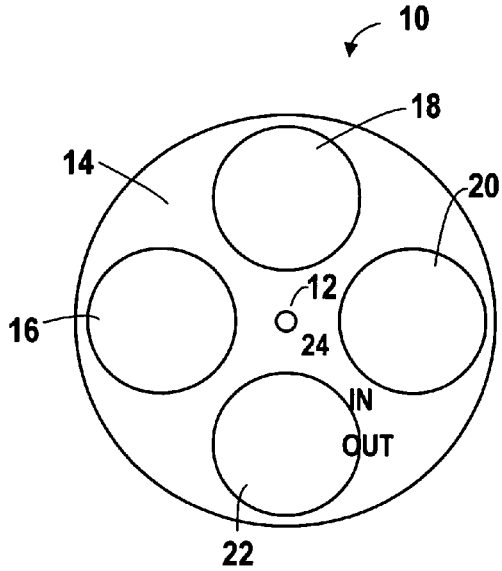
FIG. 2 is a top plan view of the scented candle of FIG. 1.

FIG. 2 is a cross-sectional view of the candle 10 showing the cylindrical outline of the candle 10 and the outer portion 14. Within the outer portion 14 are the four inner portions 16, 18, 20 and 22 which likewise are of a cylindrical shape. The wick 12 extends through the candle 10 in the middle between the portions 16 through 22 and does not extend through these separate portions, and may not even contact the inner portions. Instead, the wick 12 is extending only through the wax of the outer portion 14.

The burning of the candle 10 causes the wax of to form a pool of liquid wax around the wick. The melting of the wax to form this pool results in the wax of the outer portion 14 as well as the wax of the inner portions 16, 18, 20 and 22 all melting together. The scent agents in the various waxes blend together to create a scent that did not exist until the blending of the melted wax during burning of the candle. Thus, a new scent is formed. This scent is freshly mixed and has not deteriorated with aging effects.

The scent emitted by the candle may change during burning as the different scents reach the flame in different concentrations. In other words, the candle may emit a scent that is equal parts of all the scents present in the inner portions and the outer portion, or at times the scent emitted may more heavily favor one scent over another. This effect of favoring one scent over another may be the result of a breeze or other effect on the flame that melts one portion of the candle more than another, or may be the result of thermally induced flow of the liquid wax in the pool.

The candle of the preferred embodiments has the inner portions with the different scents extending longitudinally relative to the burning direction or wick direction. In one embodiment, all of the inner portions extend substantially the full length of the candle so that the different scents are present for mixing during burning during the entire burning of the candle. It is, however, contemplated, that the inner portions may be less than the full length of the candle, all being of the same length and arranged with the ends in a common plane, or the inner portions may be positioned with different portions ending or beginning at different positions along the length of the candle. The inner portions may also be of mutually different lengths. These latter arrangements provide one or more of the scents during burning of one part of the candle and other scents, such as the blended or mixed scent, during burning of other parts of the candle.

The candle of FIGS. 1 and 2 is formed by first forming the individual inner portions 16 through 22 of a wax having a higher melting temperature and placing these inner portions within a mold in a predetermined arrangement and thereafter pouring into the mold a wax 14 of a lower melting temperature. The wax of the lower melting temperature 14 is maintained at a temperature below the melting point of the inner portions so that the inner portions 16 through 22 remain intact during formation of the candle and are separated by one another by the lower melting point wax 14 of the outer portion. However, the inner portions 16 through 22 should not have such a high melting point that they fail to melt and diffuse during normal burning of the candle. According to a preferred embodiment of the invention, the melting points of the waxes are 144° and 152° F. respectively, although other combinations of waxes could have different melting temperatures.

The inner portions are preferably arranged so as to not contact one another. This prevents interaction of the scent agent in one portion with the scent agent in another portion. The wax of the output portion 14 is between these inner portions so that no reaction can occur between the scent agents of the different inner portions. Further, the outer portion wax seals the inner portions against exposure to air and prevents dissipation of the scent agent over time. Freshness of the scent is maintained, even during extended storage.

Figure 3:
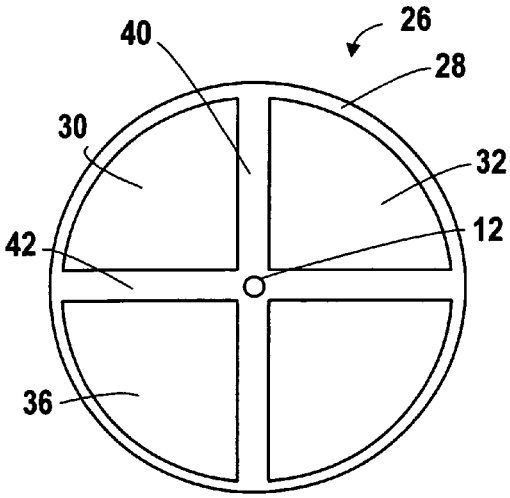
FIG. 3 is a cross-section of a scented candle of a second embodiment.

While FIG. 2 shows the inner portions of a cylindrical shape, it is of course possible that the inner portions may have a shape other than cylindrical. For instance, FIG. 3 shows a cross-section of a candle 26 having a cylindrical shape with an outer portion 28 that encases four pie-shaped segments 30, 32, 34 and 36. The wick 12 is disposed between the pie-shaped segments 30 through 36 and the wax of the outer portion 28. In particular, the outer portion 28 forms dividers or walls 40 and 42 that separate the pie-shaped segments from one another and keep the segments spaced apart and out of contact. In this way, the scent components of the segments 30 through 36 are not in contact with one another.

The candle of FIG. 3 is formed in a similar way in that the pie-shaped or wedge-shaped segments 30, 32, 34, 36 are formed of waxes having a higher melting point which are then placed into a mold and the mold is filled with a wax of the a lower melting point to encase the segments or wedges and form the candle 26. The wedge-shaped segments of a preferred embodiment extend along substantially the entire length of the candle, expect for a covering over the top and bottom. However, as noted above, it may be possible for the wedge-shaped segments to extend only part of the length of the candle, and be either co-extensive or positioned at different locations along the candle burn length.

Figure 4:
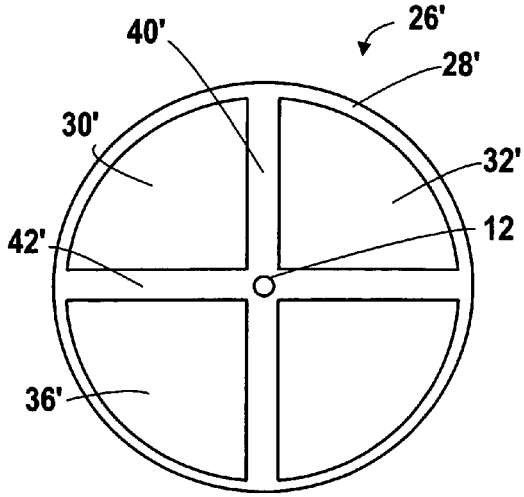
FIG. 4 is a cross-section of yet another embodiment of the present scented candle.

As an alternative approach to manufacturing of the present multi-scented candle, FIG. 4 shows a candle 26' having an outer portion 28' and four wedge-shaped inner portions 30', 32', 34', 36'. The wedge-shaped portions 30' through 36' are separated by dividing walls 40' and 42'. The candle of FIG. 4 appears quite similar to the candle of FIG. 3. However, the candle of FIG. 4 is formed by first forming the outer portion 28' and the dividing walls 40' and 42' of a wax having a higher melting point. This leaves wedge-shaped openings in the candle which are then filled with waxes of a lower melting point that is provided at a temperature below the melting point of the wax of the outer portion 28' and dividing walls 40' and 42'. Preferably, the lower melting point waxes of the wedge-shaped portions 30' through 36' are provided in the wedge-shaped spaces simultaneously with one another to avoid softening and mis-shaping the dividing walls 40' and 42'.

The method for manufacture of the present candle may thus entail forming the inner portions first of a wax of higher melting point and then forming the outer portion of a wax of lower melting point, or forming the outer portion of a wax of higher melting point and then providing the inner portions of a wax of lower melting point. The lower melting point wax is preferably added to the wax of the higher melting point while at a temperature below the higher melting point. A further although less preferred way of forming the present candle provides that wax heated to be semi-solid is pressed together with the scented portions while pliable and then alloyed to cool to envelope the inner portions. Regardless of the method for manufacture, the inner portions may be off various shapes and sizes.

An candle within the scope of this invention has blocks or shapes of scented wax of different scents placed into a larger mold and covered with an outer portion of wax. The scents of the blocks or shapes blend during burning of the candle. The blocks or shapes may be placed in predetermined locations in the candle, one example of which is shown in FIG. 1 or in some other planned arrangement, or may they may be randomly placed into the mold for an unpredictable blending of the scents. Of significance is that the scents of the different portions blend during burning of the candle.

Two scent combinations that are particularly pleasant are presented here by way of example—however, obviously an essentially infinite variety of fragrances could be produced by this concept.

The first combination, designated "Candy Store", is a 100 g (gram) candle, wherein four tubular candles are utilized in a configuration similar to that shown in FIG. 1. According to this configuration, the outer shell comprises approximately 60 g of wax and fragrance concentrate, and each tubular candle insert comprises approximately 10 g each. The shell comprises an 8% fragrance level of a vanilla accord or scent, and the four tubular candle inserts comprise the following stoichiometric percentages: caramel accord 8%; chocolate accord 2%; nut accord 3%; and orange accord 5%.

The second combination, designated "White Tea & Ginger", is a 100 g candle, wherein four tubular candles are also utilized in a configuration similar to that shown in FIG. 1. According to this configuration, the outer shell comprises approximately 52.68 g of wax and fragrance concentrate, and each tubular candle insert comprises approximately 11.83 g each. The shell comprises an 8% fragrance level of a musk accord, and the four tubular candle inserts comprise the following stoichiometric percentages: green citrus accord 4.3%; herbal spice accord 2.1%; floral accord 6.3%; and fruit accord 8.4%. The term accord is used to denote scents as an analogy of individual musical notes that combine to create a harmonious whole.

The examples set forth above illustrate but just a few of the possible candle constructions that are in the scope of the present invention. For example, the candle need not be of a cylindrical shape but may be of many different shapes including but not limited to spheres, cubes and rectangular blocks and various fanciful forms and sculptures, tapers, pyramids and many other shapes. The examples set forth provide four different inner candle portions, but this number may be increased or decreased as desired so that a candle may have two inner components, three inner components, five, six, seven or more inner components.

The cylindrical cross sections shown and described have all been constant so that the scents produced would not vary over time as the candle is burned. However, it is possible to construct the candle as having varying cross sections so that the blend of scents changes as the candle is burned. This could be accomplished by having some of the inner portions constructed as cones or pyramids, while others are constructed as inverted cones or pyramids. Other shapes of different cross section along their length may be provided as well. Or, certain sections of inner portions could occupy only a portion of the vertical axis defined by the wick.

The inner components may be all be of the same color or may be of mutually different colors and the outer portion may be of the same color as one or more of the inner components or of a completely different color. Any coloring is optional. Decorative materials may be added to the outside of the candle, embedded in the candle or otherwise applied to the candle or utilized with the candle to provide various decorative effects.

As noted previously, the different portions of the candle are provided with scents or scent components or accords. These scents are provided in different percentage levels in the different portions. Although it is possible that the different portions could each be provided with a scent in its own right, it is possible that the different scent agents would not be a scent itself or would not be a significant scent alone but when the scent agent is combined with the other scent agents from other portions may react or otherwise combine to form the scent.

Thus, a candle and method are provided that provides multiple scent portions at a given location along the burn length of the candle, these multiple scent portions melting together to produce a new scent from a combination of the scents of the multiple portions as the candle burns.

Although other modifications and changes may be suggested by those skilled in the art, it is the intention of the inventors to embody within the patent warranted hereon all changes and modifications as reasonably and properly come within the scope of their contribution to the art.

TABLE OF REFERENCE CHARACTERS

| | |
|---|---|
| 10 | scented candle |
| 12 | Wick |
| 14 | outer coating |
| 16, 18, 20, 22 | inner portions |
| 26, 26' | scented candle |
| 28, 28' | outer portion |
| 30, 30', 32, 32', 34, 34', 36, 36' | pie (or wedge) - shaped segments |
| 40, 40', 42, 42' | dividing walls |

What is claimed is:

1. A candle, comprising:

a candle body having a vertical extent;

a first section of wax and a first fragrance encased within said candle body, said first section extending a substantial portion of said vertical extent of said candle body;

a second section of wax and a second fragrance encased within said candle body; said second section extending a substantial portion of said vertical extent of said candle body, said first and second sections being of a same length and extending between the same two horizontal planes;

an outer portion of wax encasing said first and second sections and defining said candle body; and a wick extending substantially vertically through said candle body, said wick being in sufficient proximity to said first and second sections to cause at least portions of said first and second sections to melt during burning of said wick so that said first and second fragrances melt together in a pool at said wick;

wherein said wax of said outer portion extends between said first and second sections at a divider, and said wick extends through said wax of said divider.

2. The candle as claimed in claim 1, further comprising:

a third section of a wax and a third fragrance, said third section being embedded in said outer portion of wax of said candle body; and a fourth section of a wax and a fourth fragrance, said first and second and third and fourth sections being of a same length and extending between the same two horizontal planes along a majority of a length of the candle along an axis substantially parallel to said wick.

3. The candle as claimed in claim 1, wherein said sections each have a circular cross-section.

4. The candle as claimed in claim 1, wherein said sections each have a pie-shaped cross-section.

5. The candle as claimed in claim 1, wherein said outer portion of wax has a first melting temperature;

said first section of wax and said first fragrance having a second melting temperature that is different than said first melting temperature;

said second section of wax and said second fragrance having a melting temperature that is different than said first melting temperature; and wherein said first melting temperature is higher than said second melting temperature.

6. The candle according to claim 1, wherein said outer portion of wax has a first melting temperature; said first section of wax and said first fragrance has a second melting temperature that is different than said first melting temperature; said second section of wax and said second fragrance has a melting temperature that is different than said first melting temperature, and wherein said second melting temperature is higher than said first melting temperature.

7. The candle according to claim 6, wherein one of said first melting temperature and said second melting temperature is a higher melting temperature of wax of approximately 152° F, and another of said first melting point and said second melting point is a lower melting temperature of wax of approximately 144° F.

8. A candle as claimed in claim 1, further comprising:

a third section of wax and a third fragrance encased within said candle body; and a fourth section of wax and a fourth fragrance encased within said candle body, said first and second and third and fourth sections being disposed adjacent said wick so that burning of said wick creates a pool of melted wax having in said pool wax of said first and second and third and fourth sections simultaneously.

9. A candle as claimed in claim 1, wherein said wax of said first and second sections is of a different melting temperature than the wax of said outer portion.

10. A candle comprising:

a candle body having an outer portion of a first wax having a first melting temperature, said outer portion encasing forming an outer surface of said candle body;

a first inner section of a second wax and a first fragrance additive, the second wax having a second melting temperature that is different than said first melting temperature, said first inner section being embedded in said first wax of said candle body;

a second inner section comprised of a third wax and a second fragrance additive, the third wax having a melting temperature that is different than said first melting temperature, said second inner section being embedded in said first wax of said candle body, said outer portion and said first and second inner sections being molded together to form a substantially solid body;

a wick extending within the candle, said first and second inner sections being of a same length and extending between the same two horizontal planes and at least a portion of said wick extending between the horizontal planes such that said first wax and said second wax and said third wax melt simultaneously and combine and are vaporized by the wick when burning to thereby produce a fragrance, said fragrance including a combination of said first fragrance additive and said second fragrance additive;

a third inner section of a wax and a third fragrance, said third inner section being embedded in said first wax of said candle body; and a fourth inner section of a wax and a fourth fragrance, said first and second and third and fourth inner sections being of a same length and extending between the same two horizontal planes along a majority of a length of the candle along an axis substantially parallel to said wick;

wherein the first wax includes a fragrance at an 8% fragrance level of a vanilla accord, the first fragrance being an 8% caramel accord, the second fragrance being a 2% chocolate accord, the third fragrance being a 3% nut accord, and the fourth fragrance being a 5% orange accord.

11. A candle comprising:

a candle body having an outer portion of a first wax having a first melting temperature, said outer portion encasing forming an outer surface of said candle body;

a first inner section of a second wax and a first fragrance additive, the second wax having a second melting temperature that is different than said first melting temperature, said first inner section being embedded in said first wax of said candle body;

a second inner section comprised of a third wax and a second fragrance additive, the third wax having a melting temperature that is different than said first melting temperature, said second inner section being embedded in said first wax of said candle body, said outer portion and said first and second inner sections being molded together to form a substantially solid body;

a wick extending within the candle, said first and second inner sections being of a same length and extending between the same two horizontal planes and at least a portion of said wick extending between the horizontal planes such that said first wax and said second wax and said third wax melt simultaneously and combine and are vaporized by the wick when burning to thereby produce a fragrance, said fragrance including a combination of said first fragrance additive and said second fragrance additive;

a third inner section of a wax and a third fragrance, said third inner section being embedded in said first wax of said candle body; and a fourth inner section of a wax and a fourth fragrance, said first and second and third and fourth inner sections being of a same length and extending between the same two horizontal planes along a majority of a length of the candle along an axis substantially parallel to said wick;

wherein the first wax includes a fragrance at an 8% fragrance level of a musk accord, the first fragrance being a 4.3% green citrus accord, the second fragrance being a 2.1% herbal spice accord, the third fragrance being a 6.3% floral accord, and the fourth fragrance being an 8.4% fruit accord.

* * * * *